US009196438B2

(12) United States Patent
Senne et al.

(10) Patent No.: US 9,196,438 B2
(45) Date of Patent: Nov. 24, 2015

(54) SAFETY SYSTEM FOR HIGH VOLTAGE NETWORK GROUNDING SWITCH

(71) Applicants: Douglas L. Senne, Warren, OH (US); Adam M. Sewell, Warren, OH (US); Jeremy A. Sewell, Southington, OH (US); Larry E. Dix, Cortland, OH (US); Thomas H. Davis, Sharpsville, PA (US); Frank D. Depuy, Youngstown, OH (US)

(72) Inventors: Douglas L. Senne, Warren, OH (US); Adam M. Sewell, Warren, OH (US); Jeremy A. Sewell, Southington, OH (US); Larry E. Dix, Cortland, OH (US); Thomas H. Davis, Sharpsville, PA (US); Frank D. Depuy, Youngstown, OH (US)

(73) Assignee: Quality Switch, Inc., Newton Falls, OH (US)

( * ) Notice: Subject to any disclaimer, the term of this patent is extended or adjusted under 35 U.S.C. 154(b) by 0 days.

(21) Appl. No.: 14/339,622

(22) Filed: Jul. 24, 2014

(65) Prior Publication Data

US 2015/0027987 A1 Jan. 29, 2015

Related U.S. Application Data

(60) Provisional application No. 61/858,787, filed on Jul. 26, 2013.

(51) Int. Cl.

| | |
|---|---|
| ***H01H 33/42*** | (2006.01) |
| ***H01H 33/02*** | (2006.01) |
| ***H01H 33/50*** | (2006.01) |
| ***H01H 33/68*** | (2006.01) |
| ***H01H 33/53*** | (2006.01) |

(52) U.S. Cl.

CPC ..... *H01H 33/022* (2013.01); *H01H 33/50* (2013.01); *H01H 33/53* (2013.01); *H01H 33/68* (2013.01); *H01H 2239/044* (2013.01)

(58) Field of Classification Search

CPC ..... H01H 33/42; H01H 2033/6667; H01H 33/6661; H01H 33/666; H01H 11/00

See application file for complete search history.

(56) References Cited

U.S. PATENT DOCUMENTS

| | | | | |
|---|---|---|---|---|
| 4,293,834 | A * | 10/1981 | Date | H01H 3/3042 200/400 |
| 2012/0300358 | A1* | 11/2012 | Johnson | H01H 3/40 361/268 |
| 2014/0097069 | A1* | 4/2014 | Endre | H01H 1/502 200/290 |
| 2014/0104758 | A1* | 4/2014 | Bjortuft | H01H 31/003 361/605 |

OTHER PUBLICATIONS

ABB Inc. Small Power Transformers, Liquid Insulated Network Transformers, Small Power Transformers Instruction Book NT-1002 Rev. Oct. 15, 2001, ABB Inc., South Boston, VA, USA.

Quality Switch Inc., Contact Adjustment Manual Liquid Immersed Network Grounding Switches, Nov. 2, 1998, Quality Switch Inc., Newton Falls, OH, USA.

Quality Switch Inc., Instruction Manual Liquid Immersed Netwoek Grounding Switches, Jun. 14, 2002, Quality Switch Inc., Newton Falls, OH, USA.

General Electric Co. Transformer Business Department, Network Transformers (Oil-Immersed) with Switch, Installation Accessories and Maintenance GEI-41726, Hickory, NC, USA.

* cited by examiner

*Primary Examiner* — Truc Nguyen

(74) *Attorney, Agent, or Firm* — Roth Blair Roberts Strasfeld & Lodge

(57) ABSTRACT

The present invention is directed to a safety system integrated into a liquid-insulated high voltage network grounding switch, including modifications to the switch structure to provide an arrangement that is more efficiently installed with greater precision than found in conventional arrangements. The result is a switch assembly that adheres to updated IEEE/ANSI Standards, while still fitting into existing vault space meant to accommodate earlier switch gear.

12 Claims, 7 Drawing Sheets

| ITEM | DESCRIPTION | ITEM | DESCRIPTION |
|---|---|---|---|
| 1 | SOLENOID DECK ASSEMBLY | 35 | STOVER NUT |
| 2 | INDEX PLATE ASSEMBLY | 36 | STOVER NUT |
| 3 | HANDLE ASSEMBLY | 37 | HEX NUT |
| 4 | HUB-BLADE ASSEMBLY | 38 | ALLEN FLATHEAD SCREW |
| 5 | GLAND/O-RING ASSEMBLY | 39 | ALL-THREAD STUD |
| 6 | NETWORK SWITCH CONTACT ASSY. | 40 | ALL-THREAD STUD |
| 7 | SOLID END-CONNECTORS | 41 | ALL-THREAD STUD |
| 8 | CONTACT CLIP | 42 | ALL-THREAD |
| 9 | RETAINING RING | 43 | CAP SCREW |
| 10 | INTERLOCK CAM | 44 | CAP SCREW |
| 11 | SPACER | 45 | RETAINER SCREW |
| 12 | MOLDED SPACER | 46 | ALLEN HEAD CAP SCREW |
| 13 | TUBULAR SLEEVE INSULATOR | 47 | HEX BOLT |
| 14 | DECK TIE DOWN | 48 | HEX BOLT |
| 15 | CONTACT BUS SUPPORT | 49 | HEX BOLT |
| 16 | GLAND BODY | 50 | LEAF SPRING |
| 17 | DRIVE SHAFT END CAP | 60 | TANK |
| 18 | MOUNTING RAIL | 62 | CONTACT PADS |
| 19 | MOUNTING RAIL | 65 | PAIRED BLADE CONTACT |
| 20 | DRIVE SHAFT | 66 | SECONDARY SWITCH BLADES |
| 21 | THREADED SOLID PIN | 67 | GROUND TERMINAL |
| 22 | ROLL PIN | 70 | INCOMING SERVICE BUSHING |
| 23 | ROLL PIN | 72 | BUSHING CONTACT POINTS |
| 24 | ROLL PIN | 90 | FLEXIBLE CONNECTORS |
| 25 | INTERNAL STAR LOCK | 100 | SWITCH GEAR ASSEMBLY |
| 26 | BELLEVILLE WASHER | 101 | SLOT |
| 27 | BELLEVILLE WASHER | 161 | ALIGNMENT KEY |
| 28 | BELLEVILLE WASHER | 171 | END CAP OFF-SET PROTRUSION |
| 29 | FLAT WASHER | 300 | SHEAR PIN |
| 30 | NUT | 301 | HANDLE EXTENSION |
| 31 | WELD NUT | 302 | OFF-SET NOTCH |
| 32 | SERRATED FL. NUT | 303 | COLLAPSIBLE HANDLE EXTENSION |
| 33 | SQUARE NUT | | |
| 34 | STOVER NUT | | |

FIG-7B

SAFETY SYSTEM FOR HIGH VOLTAGE NETWORK GROUNDING SWITCH

PRIORITY INFORMATION

The present application is based upon U.S. Provisional Patent Application 61/858,787, filed Jul. 26, 2013.

FIELD OF THE INVENTION

The present invention generally relates to a safety system integral to a high voltage network grounding switch. In particular, the present invention is directed to various modifications of conventional liquid insulated high voltage network grounding switches to provide enhanced safety and capability of the subject high voltage network grounding switch.

BACKGROUND ART

Liquid insulated high-voltage network grounding switches have been used for a long time in the implementation of high voltage system electrical distribution. Very often, such switches are used in conjunction with transformers, and are even mounted on liquid-insulated transformers for the sake of convenience. Examples of such switches are found in the cited publications.

These publications include liquid insulated network transformers by: ABB, Inc., publication number MT-1002, revised Dec. 15, 2001; General Electric publication, GEI-41725 B, entitled Network Transformers, Oil Immersed with Switch; Quality Switch Publication dated Nov. 2, 1998, entitled Liquid Immersed Network Grounding Switches; and, Quality Switch Publication dated Jun. 14, 2002, entitled Liquid Immersed Network Grounding Switches. All of the aforementioned cited publications provide examples of conventional art liquid-insulated high-voltage network grounding switches built in accordance with IEEE/ANSI Standards C57.12.40; Sections 8.2.3.3.1; 8.2.3.3.2; and 8.2.3.3.3.

The subject IEEE/ANSI Standards apply to rotary, 3-phase switches, operated on a shaft, and rotated to three different positions, The order of operation is "open," "closed,", and "grounded."Such switches are designed to be operated only under conditions of no load. Some variations, such as a "mag-break" can accommodate the interruption of only magnetizing current, using a spring-loaded contact arrangement. Otherwise, the "mag-break" is essentially the same as the dead-break type of switch.

For both types of liquid-insulated high voltage network grounding switches, which are meant to open solely under no-load conditions, there are a number of safeguards that are already standard in the industry, and are described in the aforementioned conventional art publications. These include a solenoid interlock that hinders operation of the rotary grounding switch when an excitation current is detected on the primary of an associated transformer. A toggle switch is also conventionally used in order to delay any attempted operation of the grounding switch in case of questionable conditions. These safety features are used to make certain that these non-load break switches cannot be operated when the inputs of the switches are energized for carrying a load. This is normally done by detecting primary activation of transformers or other sources that might be feeding the subject switch.

Safety measures have been an integral part of such switches since there are any number of catastrophic occurrences that take place during the operation of such switches. For example, fault or other high current occurrences can weld the switch, or otherwise damage it. Further, aggressive use by operators or other maintenance workers can also damage the switch by attempting to force it into positions counter to the conventional interlocks installed on such switches. The switches are conventionally designed to fail at preselected places as the weakest link in the overall system will fail first. In many cases mechanisms inside the switch drive system would be the weak link. In some cases, the interlock mechanism would not hold if high enough torque was applied (typically by using an extension piece of pipe as an added lever arm). In other cases after the switches have seen a fault, the insulating drive mechanism would break before the contact welds would be broken, but the exterior connection to the handle would not break. This created situations where the crew would think the switch was in a position based on the handle location, but the actual switch drive mechanism would no longer be rotating since it was detached. Since the switch is in a chamber (liquid containment tank) it is not visible to the crew. In order to get this back into service, it would typically require replacing the entire switch mechanism and this would require removing the entire transformer from service. One feature of such liquid containment tanks is the use of high voltage bushings which contain exterior and internal connection points (i.e., to external power sources and internal contact points, respectively, for connection to the switch once it has been installed). Correctly and accurately positioning the switch within the liquid containment tank is often difficult, especially when alignment with the exterior operating handle has to be taken into account.

Further, installation crews that are not familiar with a particular switch manufacturer or switch configuration may very well misalign the switch during installation. For example, when aligning the network switch contact assembly 6 on the operating shaft with the correct position of the external handle 3, there is generally some sort of accuracy (i.e. position) adjustment that must take place. This requires a certain amount of tolerance in the positioning of the switch to be secured within the liquid-tight tank. This means that conventional rigid connections between the input contacts of the rotary switch and the interior contacts on the bushings often do not align properly. In some cases, therefore, conventional rigid contacts may actually create misalignment of the switch with other elements (such as the liquid containment tank grounding connections, the liquid-tight gland, and the external handle), so that both the safety and the operability of the switch is compromised.

Further, when mounting a large electrical device to be grounded (such as a switch) within a liquid containment tank or chassis, which is also grounded, there can be other difficulties. Very often connection between the electrical device and the chassis or liquid containment tank is compromised so that a high resistance ground might develop between the liquid containment tank and the electrical device. Still further, if the electrical device is extensive, as is the case for a grounding switch, different potentials may develop on different parts of the switch that are meant to be grounded. High resistance ground connections are inherently dangerous, especially under fault or other high current occurrences. Under fault conditions, a high resistance or otherwise faulty ground connection anywhere between the switch and the liquid containment tank (as well as between the liquid containment tank and the system ground) can lead to local or general destruction of the electrical system. All too often, this possibility is ignored when making the ground connection during installation of the switch.

Further yet, if the switch has become misaligned within the liquid containment tank, pre-formed ground connections between the switch and the liquid containment tank often become bent, crimped, or stressed so that it is difficult to make a good ground connection between the liquid containment tank and parts of the switch that are meant to be grounded. Once the questionable connection is made, mechanical and electrical stresses will tend to degrade the connection even further. Very often, installers simply do not make the best practical ground connections, even when provided with explicit instructions. The same is often true with connections to parts that receive high-voltage. This is especially true if an easy fit cannot be arranged between the interior bushings, the switch terminals, and the pre-configured connectors to be attached therebetween.

Very often, the placement of the switch within the liquid containment tank results in a situation where the switch input contacts do not align properly with the bushing contacts. This often results in an effort by the installers to reconfigure rigid connectors between the two, often resulting in the degradation of the connecting links or the connections between the connecting pads or terminals. At high-voltages and high currents, any compromise of connections at any point can result in substantial deterioration and even dangerous conditions.

Difficulties in making accurate or secure electrical connections can be exacerbated by difficulties in aligning the switch shaft, which is interior to the insulating liquid-filled tank and the external handle. It is common for the operating handle to be connected to the switch shaft in a position that is incorrect for the position of the switch. If such an error is not readily detected and corrected, the switch can be misused or can malfunction in any number of different ways. Even when explicit instructions are provided, installers can still misinterpret them, or simply ignore them, aligning the operating handle with the rotation of the switch drive shaft in any way that seems most convenient at the time. All too often, it has been discovered that when dealing with installing contractors, the assembly or installation of high-voltage switch gear has to be rendered as "foolproof."

As additional background in this case, conventional high voltage grounding switch designs usually include "heel contacts." Moreover, there are inherent difficulties with this conventional type of rotary switch connection. Firstly, a great deal of pressure must be used to insure a proper high-voltage connection between the rotary shaft of the switch and the "heel contact." This means that greater torque is necessary to simply operate the switch. Conventional "heel contacts" are rigid in nature, making alignment with the contact points of the incoming bushings difficult. This in turn, leads to difficulties in aligning the switch shaft with the external operating handle. All of this increases the difficulty of aligning the output contacts of the switch with the output contacts on the liquid containment tank, which is inherently exacerbated by the tendency of some installers to simply force the various pieces to fit in the most expedient manner available.

The greater torque required by the "heel contacts" means that the amount of torque needed to simply move the switch from a connected position to an open position becomes far more difficult. Further, if the switch blades have an extremely tight contact with the output or secondary contacts of the switch, opening the switch may become extremely difficult. This is still further complicated by the fact that indoor vaults (where such switches are usually mounted) are already as compact as designers can make them.

It is also important to note that, under high current caused by impulse or faults, the "heel contacts" have a tendency to weld so that the switch cannot be rotated. When such welding occurs, there is usually no way to break the "heel contacts" free from the shaft. This normally results in the necessity of scrapping the entire switch. As such, the "heel contacts" constitute the weakest part of the switch gear arrangement, while also constituting a part that is virtually impossible to repair without replacing the entirety of the switch. From an economic standpoint, this can be disastrous for operation of the system.

Still other problems with existing grounding switches often include the switch handle. More specifically, limited vault space for the mounting and installation of the subject grounding switches usually leads to foreshortened operating handles so that the switches can be more easily placed within the confined space. Unfortunately, if a switch proves to be inconveniently confined in a tight workspace for the operating staff, the standard, simple and expedient step to more easily operate the handle is to slip a long pipe over the handle in order to provide far more torque. Unfortunately, this often used technique often provides more torque than the switch components can tolerate and damage very often occurs. Also, as a result of the increased torque required by the "heel contacts", the connection between the switch blades and the secondary output connections on the switch may not be as tight as desired. Increasing the tension of the switch blades with the secondary contacts may render the switch very difficult to operate and even more subject to accidental damage.

On the other hand, relatively loose contact between the switch blade and the secondary switch connections that interact with the blades when the switch is closed, may have disastrous effects under fault conditions. Under such conditions, there is a tendency for "blow-off" to occur. When this does happen, the switch opens, often destructively. This can create serious problems with the overall system, as well as creating opportunities for additional faults due to broken parts of the switch blades being randomly propelled through the insulting liquid.

The industry recognized these problems inherent in high-voltage liquid-insulated network grounding switches, and it addressed them by amending the IEEE/ANSI standard C57.12.40 in 2011, as published. In summary, a far safer and more robust switch is required to meet the new standards. Unfortunately, these enhanced and safer switches must still fit into the original vault spaces designed for the earlier, less robust switches. Of necessity, for example, the size of containment tanks for upgraded switches may be difficult to change due to space limitations and outside confinements. Further, the revised standards do not specify how all of the new requirements are to be carried out. To overcome all of the drawbacks of conventional liquid-insulated high-voltage network grounding switches, and to meet the IEEE/ANSI standards under C57.12.40, an innovative switch design as described with this invention, is necessary.

SUMMARY OF THE INVENTION

It is a first object of the present invention to overcome the drawbacks described with respect to the conventional art of liquid insulated high voltage network grounding switches with regard to system safety, switch operation and efficient installation.

It is another object of the present invention to provide an upgraded and more robust network grounding switch capable of being installed in the same confined vault spaces as previous network grounding switches of the same voltage rating.

It is a further object of the present invention to provide a network grounding switch, which can be installed without misalignment between the exterior handle and the internal contact blade placement.

It is an additional object of the present invention to provide a network grounding switch capable of maintaining a secure and low-resistance ground path.

It is still another object of the present invention to provide a network grounding switch which is easily recovered and placed back in operation after high current occurrences.

It is yet a further object of the present invention to provide a network grounding switch that remains closed under fault conditions.

It is again an additional object of the present invention to provide a liquid insulated, high voltage network grounding switch which is easily installed, repaired and/or replaced.

It is still another object of the present invention to provide a network grounding switch having an exterior handle assembly that can provide additional torque without taking up more permanent space in the installation vault.

It is yet a further object of the present invention to provide a network grounding switch having an easily installable liquid seal between the exterior of the liquid containment tank and the interior switch.

It is still an additional object of the present invention to provide a network grounding switch in which torque required to operate the switch is minimized.

It is yet another object of the present invention to provide a network grounding switch in which the required safety shear pin is located in a convenient position for more efficient repair and replacement.

It is still a further object of the present invention to provide a network grounding switch having convenient electrical connection arrangements between the switch and bushings mounted on the liquid containment tank.

It is again another object of the present invention to provide a network grounding switch that requires less external spring pressure to accommodate higher levels of blow-off force under high current conditions.

It is still an additional object of the present invention to provide a liquid insulated network grounding switch capable of accommodating a wide range of exterior connections to the liquid containment tank, without requiring additional accommodations to connect the switch to the external bushings mounted on the liquid containment tank.

It is again a further object of the present invention to provide a liquid insulated network grounding switch arranged so that the switch grounding path cannot be compromised by improper installation of the switch within its liquid containment tank.

It is yet an additional object of the present invention to provide a safety system for a network grounding switch wherein improper installation and alignment of the switch cannot be inadvertently and/or incorrectly assembled.

It is still another object of the present invention to provide a network grounding switch that meets upgraded IEEE and industry standards while still maintaining a size appropriate for existing vault spaces originally designed for conventional switches of the same voltage ratings to the old inferior standards.

It is again a further object of the present invention to provide a network grounding switch that can withstand high-current welding of portions of the switch, and still easily be put back into operation.

These and other goals and objects of the present invention are achieved in a high voltage network grounding switch safety system of the instant invention. Moreover, in this case, the safety system is operationally mounted within a liquid-tight tank wherein the network grounding switch includes a rotary multi-position, 3-phase arrangement. This arrangement includes at least three switch input connecting points, at least three rotating paired blades affixed to a shaft, where each paired blade interfaces with at least one switch output connection. The grounding switch safety system further includes a ground bus, an external ground connector, at least three secondary switch connections or blades, and incoming bushings with each bushing having internal and external electrical connection points. The liquid containment tank is configured with a mounting structure for securing at least a portion of the network grounding switch within the liquid containment tank. A liquid-tight gland for passage of the drive shaft to an external handle to control rotation of the switch from outside the tank is also preferably included in this design. The switch safety system further includes an offset interface between said external handle and the shaft of the network grounding switch. Further, an exterior safety shear pin is secured to the external handle and the drive shaft. A ground path connecting the tank interior and the switch through an internal plate fixed in proximity to the liquid-tight gland is also included. Still further, a flexible connection between at least one of the switch connecting points and at least one of the internal electrical connection points of the incoming bushings may be used. Further yet, each of the secondary switch blades preferably includes at least two contact pads. (I may be reading this incorrectly, but the stationary contact has two pads; one on each side. The rotary blades have two pads on each blade (each rotary contact has two blades, so 4 pads total on each phase).

BRIEF DESCRIPTION OF THE DRAWINGS

FIG. 7B is a detailed parts table for components of the switch assembly of FIG. 7A, as well as other components of FIGS. 1-6.

DETAILED DESCRIPTION OF THE PREFERRED EMBODIMENTS

Figure 1:
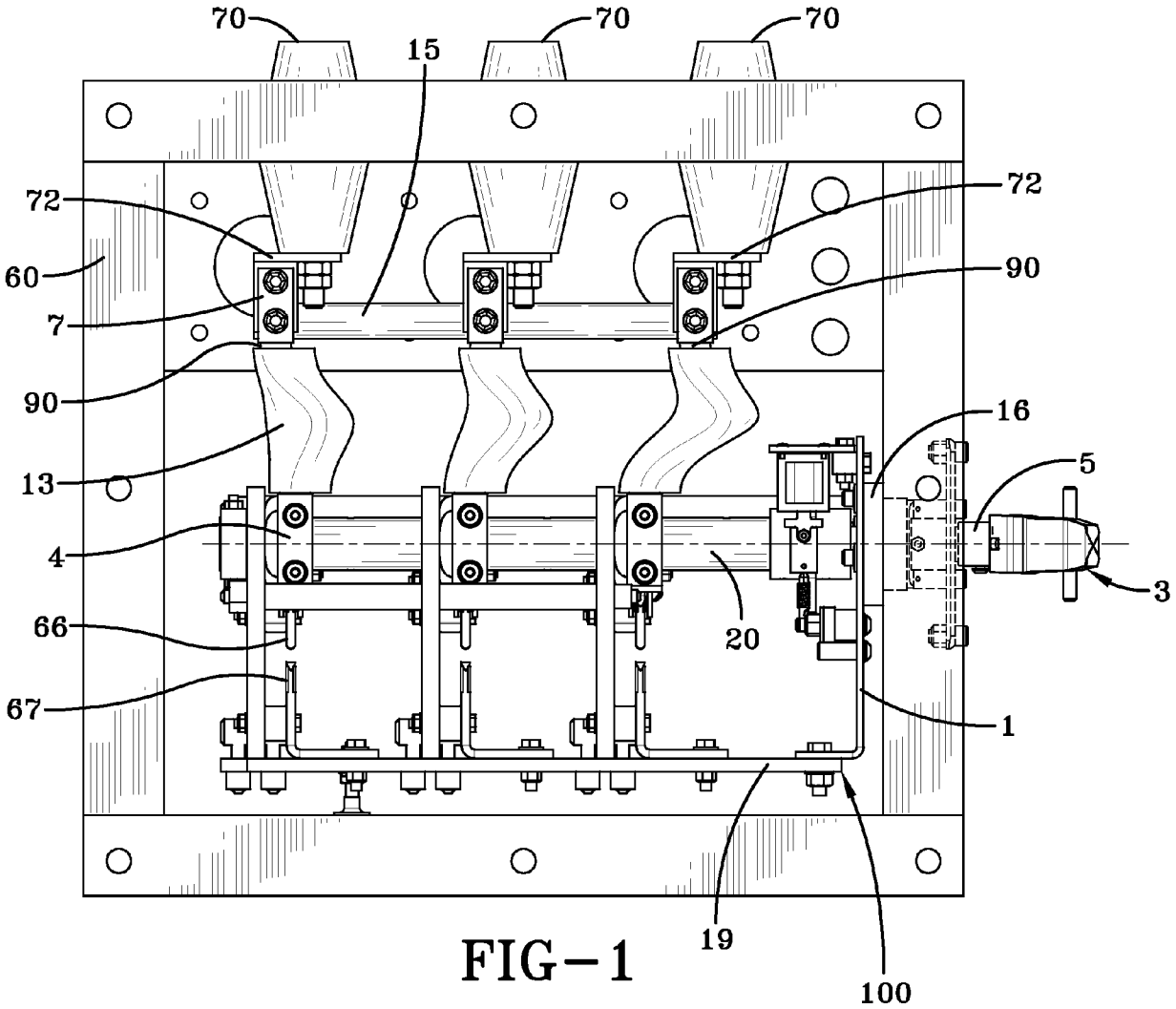
FIG. 1 is a rear elevational view of the switch assembly of the present invention as mounted in a liquid-tight tank.

The safety system of the present invention is integrated into the overall structure of a high-voltage, liquid-insulated network grounding switch gear assembly 100, mounted in liquid containment tank 60, as depicted in FIG. 1. The integration of the safety system occurs both within the liquid containment tank 60 and exterior to liquid containment tank 60. Further, liquid containment tank 60 serves as a mounting chassis for the switch gear assembly 100, as well as a grounding means for the switch assembly. As is standard in accepted electrical practice, the liquid containment tank 60 is grounded to an overall system ground (not shown) for the entire installation, which might contain additional electrical elements, such as a transformer.

Very often, switches as assembly 100 are used in conjunction with liquid-insulated transformers at the same location. While conventional methods of grounding a liquid containment tank such as 60 may be entirely satisfactory, the grounding of electrical components, such as switch gear assembly 100, within a liquid containment tank, are less well settled as described and addressed infra.

For ease of understanding and illustration herein, the switch gear assembly 100 is generally viewed outside of liquid containment tank 60, with only portions of the liquid containment tank being shown where they interact with switch assembly 100 and the inventive safety system integrated therein. However, it should be noted that tank 60 is also part of the environment in which the safety system operates.

Figure 2:
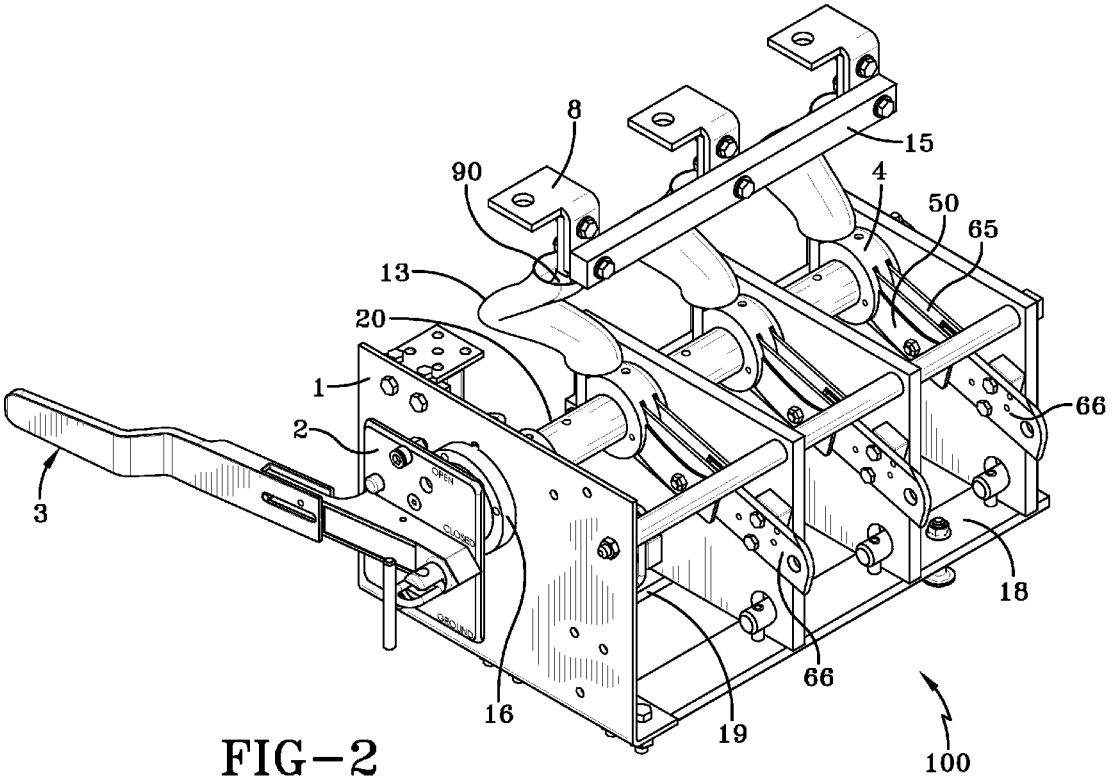
FIG. 2 is a perspective view of the switch assembly without the liquid-tight tank, the switch assembly includes a safety system of the present invention, including an external handle.

FIG. 2 shows switch gear assembly 100, illustrating both those parts that would be contained within liquid containment tank 60 and those parts that would be mounted outside of liquid containment tank 60. In FIG. 2, no portion of liquid containment tank 60 is depicted. However, it must be remembered that external handle assembly 3, index plate assembly 2 and gland O-ring assembly 5 (not shown therein) are external to liquid containment tank 60. On the other hand, solenoid deck assembly 1 and gland body 16 are interior to liquid containment tank 60. The interface (not shown) between switch tube or switch drive shaft 20 and external handle assembly 3 is contained within the liquid-tight gland O-ring assembly 5 and gland body 16. These two elements render a liquid-tight passage between the external handle assembly 3 and the switch drive shaft 20 of switch gear assembly 100.

Solenoid deck assembly 1 is typically used to mount the standard solenoid safety interlock found in most such switches. The solenoid is not shown, but constitutes a conventional part of the safety system along with its inventive components and innovative design therein. In order to insure a proper ground connection between liquid containment tank 60 (not shown in FIG. 2) and the switch gear assembly 100, solenoid deck assembly 1 is preferably bolted to the gland body 16. Further, gland body 16 is securely welded to a wall of liquid containment tank 60. Further yet, the switch gear assembly 100 is attached to solenoid deck assembly 1 via grounded mounting rails 18 and 19, thereby providing a robust grounding connection between the switch gear assembly 100 and liquid containment tank 60.

With the extensive ground connections provided by this embodiment, conventional pig tail arrangements are avoided. The grounding arrangement herein (as described above and depicted in FIG. 2) removes any chance of a high-resistance ground or grounded parts being of unequal potential in various parts of the liquid containment tank. Moreover, every part of the switch gear assembly 100, both inside and outside of liquid containment tank 60 is at the same potential with regard to the ground connections. There are no weak links such as that typically experienced with the prior art. Upon installation, all that needs to be done to insure the safety of the subject switch gear assembly 100 contained within liquid containment tank 60 is to establish a proper ground between the liquid containment tank 60 and the overall installation ground, in accordance with standard electrical procedures.

Regarding other features of the inventive safety system, the conventional manner of addressing a rotating switch connection is through the use of a "heel contact," which would otherwise slide against hub blade assembly 4, as the switch is rotated from one position to another (i.e., by rotating the switch drive shaft 20 using external handle assembly 3). The drawbacks of this type of arrangement have been described supra, and are addressed and improved by the present invention. In particular, flexible connectors 90 are provided in a manner which flex as switch drive shaft 20 turns. These flexible connectors 90 are described on page 11 of the Operation, Installation and Maintenance Instructions for the present invention, filed as part of the Provisional Patent Application 61/858,787 incorporated herein. Each flexible connector 90 is connected at one end to a switch hub blade assembly 4 and the other end to a contact clip 8 (via opposing solid end-connectors 7 of flexible connector 90).

Figure 3:
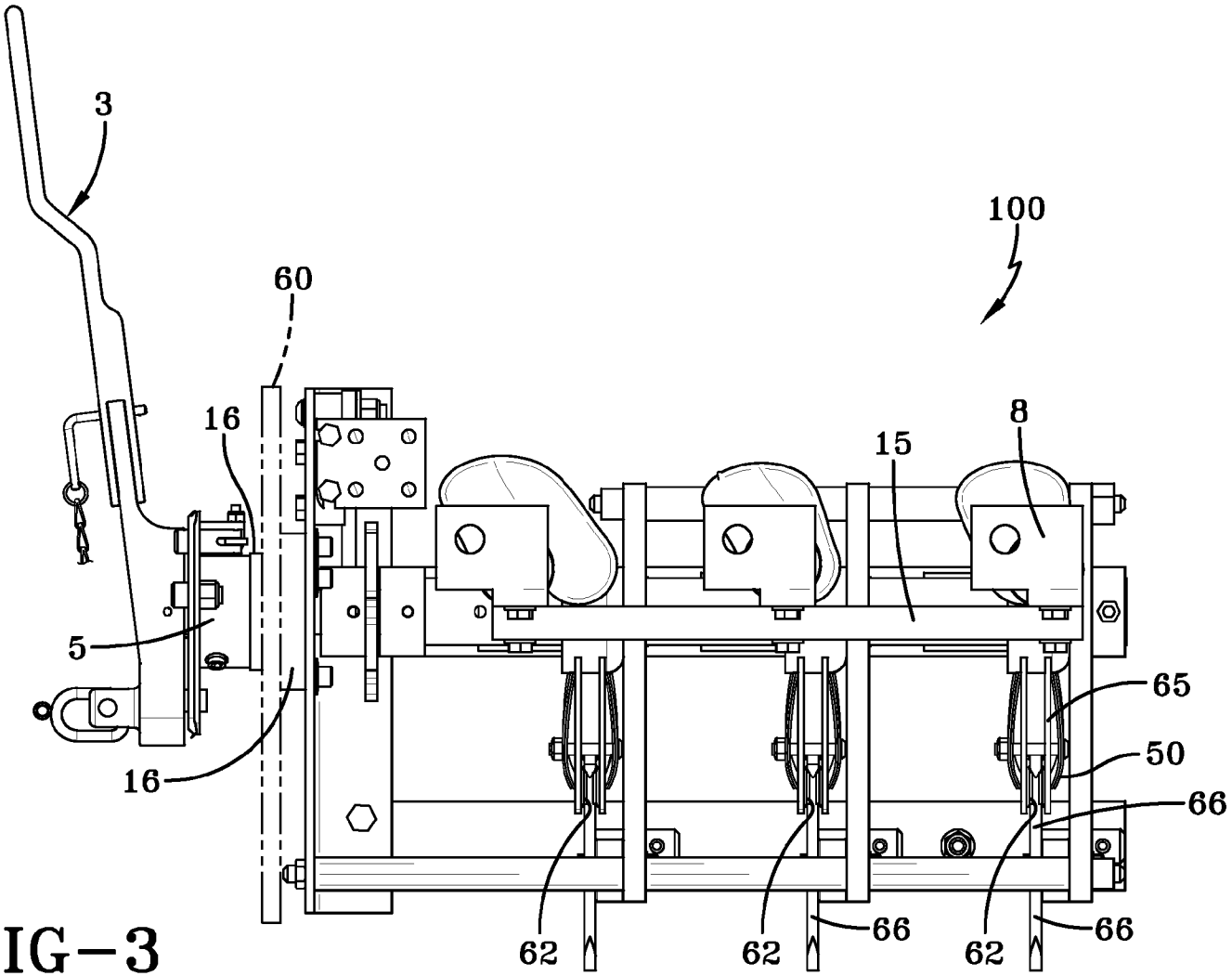
FIG. 3 is a top view of the switch assembly with a safety system integrated therein, showing the relationship between the switch gear assembly, the external handle and one wall of the liquid-tight tank.

In this embodiment, each of the three contact clips 8 is held by contact bus support 15 which is aligned so that easy connection can be made between contact clips 8 and interior bushing contact points 72 (seen in FIG. 3). This arrangement allows rigid, substantial contacts at both the switch hub blade assembly 4 on switch drive shaft 20 and at the other end on the incoming service bushings 70, which connect liquid containment tank 60 to other electrical components (not shown) at installation.

Preferably, the flexible connectors 90 are made of a braided material. Since the flexible connectors 90 link between copper terminals, it is reasonable that the flexible connectors 90 are also of copper. These braids provide a safe, flexible linkage, which is easily maintained and repaired. Further, it is preferred, but not necessary, that each of these flexible braids is covered with some type of protected tubular sleeve insulating material 13, which can be constituted from a wide range of different electrical insulating materials.

Figure 4:
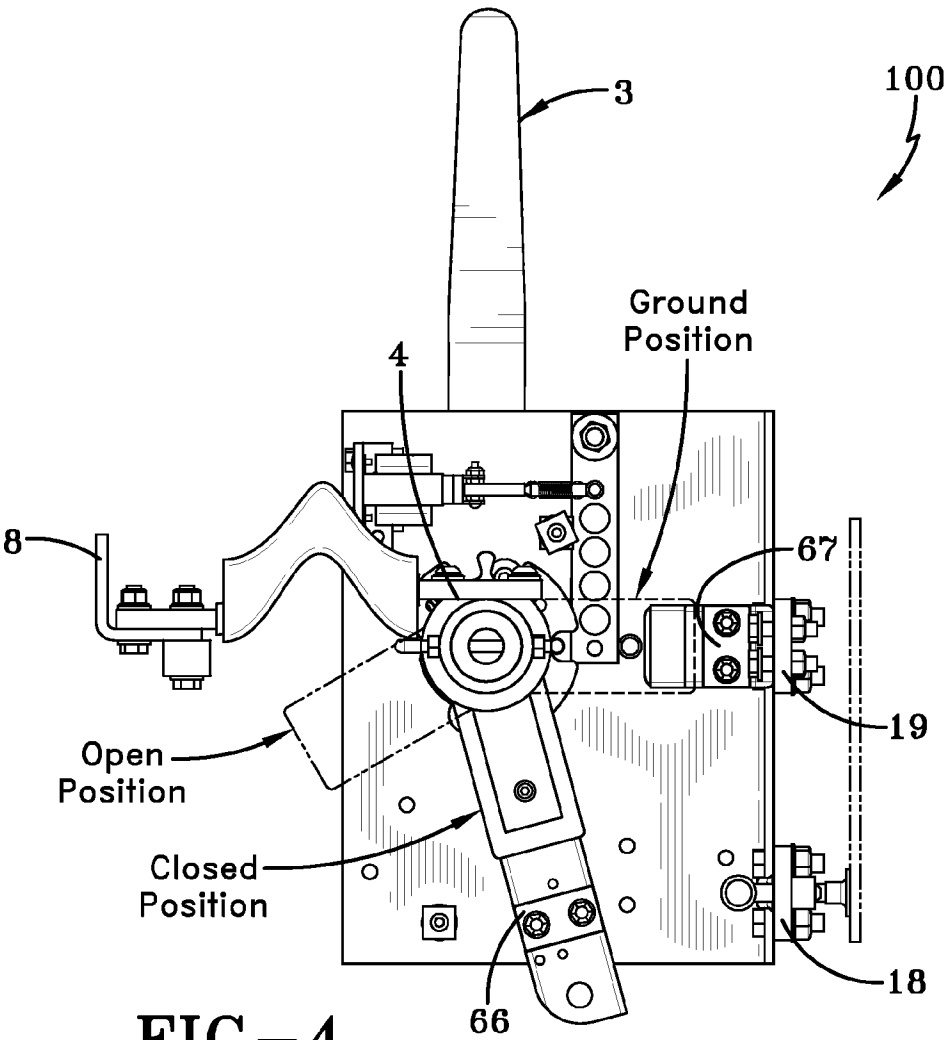
FIG. 4 is a side view, depicting one paired blade of the switch gear assembly and the three positions in which the blade can be set.

It should be noted that in FIGS. 2-4, the switch gear assembly 100 is shown in the "closed" position, wherein the secondary switch blades 66 of switch gear assembly 100 are connected to additional terminals on liquid containment tank 60 (not shown) to provide power from the secondary switch blades 66 to "downstream" devices (also not shown). Further, as is standard with switches, the switch drive shaft 20 can be further rotated using external handle assembly 3 in order to bring the switch from the "closed" position (as depicted in FIGS. 2-4) to the "ground" position by further rotating switch drive shaft 20 in a clockwise rotation to ground terminals 67, directly connected to grounded mounting rail 19 (best seen in FIG. 4 by broken lines).

With reference to FIG. 3 (i.e., the top view of the switch gear assembly 100 of FIG. 2), each phase of the switch gear assembly 100 includes a paired blade contact 65. These paired blades are put under tension by leaf springs 50. Preferably, the secondary switch blades 66 each contain two contact pads 62. The relationship between all of these elements is best depicted in the top view of FIG. 3. When the switch is in the "closed" position, each of the paired contact blades 65 straddle and pinch a single, corresponding secondary switch blade 66. Holding tension is provided by leaf springs 50. The secondary switch blades 66 of switch gear assembly 100 are connected to additional bushings on the liquid containment tank (not shown) in order to feed power from switch gear assembly 100 to downstream loads.

The use of contact pads 62 on each side of secondary switch blades 66 is done to minimize the torque requirements for operation of the switch after a short circuit. Moreover, the contact pads 62 are parallel contacts that add to a compressive force to partially off-set the "blow-off" force produced as the current flows from the stationary contact to the parallel contact pads 62. More specifically, the parallel pads are preferably attracted to each other to best disperse the "blow-off" force which, in turn, allows for a reduction of the needed applied mechanical force from the external springs (i.e., the leaf springs 50 in this embodiment).

To be clear, the use of two contact pads 62 brings about a reduction in blow-off force due to the provision of additional contact area. Because of this structure, the force needed to operate switch gear assembly 100 can be reduced since the spring pressure from leaf springs 50 is also reduced due to the operation of the contact pads 62. The improved torque characteristics are a substantial improvement over prior art designs that utilize just two flat bars with no pads.

Further, the subject contact arrangement is not nearly as susceptible to welding. This has been demonstrated under test conditions. Further, when welding did occur in this case, the switch blades 66 were much more easily separated by applying tolerable mechanical torque to switch drive shaft 20. Further, because the conventional "heel contacts" have been replaced with flexible connectors 90 in the instant embodiment, the switch gear assembly 100 can be put back into operation much more quickly after a fault, than previously. Moreover, in combination, use of the contact pads 62 and the flexible connectors 90 (i.e., eliminating of the conventional "heel contacts"), it has been found that far less torque is needed to break otherwise vulnerable welded contact points, and as a result it is less likely that the switch will be damaged when breaking welds.

With reference to FIG. 4, a side view depicting the representation of the three positions of switch gear assembly 100, the "open" position is shown in broken lines. Specifically, the switch is depicted as being in the "closed" position with the secondary switch blade 66. In operation, the switch can be rotated in a counter-clockwise direction into a "ground" position (also depicted by broken lines). Ground terminal 67 can be of the same configuration as the secondary switch blades 66.

An additional feature of this embodiment of the present inventive safety system, includes a mechanism for addressing the problem of improper installation, resulting in misalignment between the external handle assembly 3 and the position of switch drive shaft 20. This feature includes a key arrangement that makes certain that all parts of the switch assembly, especially the switch drive shaft 20 and the external handle assembly 3, are properly aligned. This designed feature also provides for proper alignment of the gland body 16 and the gland O-ring assembly 5. Moreover, in this additional feature, the gland body 16 has an alignment key 161 which fits in mating relationship into a slot 101 in the solenoid deck assembly 1 seen in FIG. 7A. In this manner, the gland body 16 will properly align with apertures for connecting the gland body 16 to the solenoid deck assembly 1.

With reference to FIG. 3 (which provides a view depicting the relationship between the gland body 16, a wall of the tank 60, the gland O-ring assembly 5, and the switch drive shaft 20 of the switch gear assembly 100), the external handle assembly 3 is connected through the gland O-ring assembly 5 and the gland body 16 to switch drive shaft 20, through an interlocking cam 10 and a drive shaft end cap 17 (best seen in FIG. 7A for assembled relationship), which fits over a portion of switch drive shaft 20. All of these parts are aligned with each other through the use of coordinated drilled holes (through the gland body 16, the solenoid deck assembly 1, and interlocking cam 10) and alignment key 161. Besides the gland body key 161, provision is made in the gland body 16 for a mounting pin 22 in the form of a roll pin (also called a spring pin in some conventions).

The gland body 16 is preferably welded in place with its smaller diameter projection passing from the inside to the outside of liquid containment tank 60 through the tank wall, as depicted in FIG. 3. The interlocking cam 10 has similar drill holes to align properly with the gland body 16. In order for this to be accomplished, the network switch contact assembly 6 will need to be installed from the front of the liquid containment tank 60 with the switch drive shaft 20 oriented in the ground position. Moreover, this must be done in order to align the three bolt holes that are used to secure the switch to the gland body 16, using interlocking cam 10 and the drive shaft end cap 17, which have been oriented together and with the switch drive shaft 20 through the use of additional roll pins such as 23. The gland O-ring assembly 5 and the gland body 16 are aligned with each other and with index plate assembly 2. All three components are connected together by the same set of three connectors.

Still further, in order to coordinate the proper position of the external handle assembly 3 with the position of the switch drive shaft 20 (of the network switch contact assembly 6), it is necessary that an alignment mechanism be provided. This is done in this case by a perpendicular handle extension 301 best seen in FIG. 5. The perpendicular handle extension 301 extends through the gland O-ring assembly 5 and into interlocking cam 10, where there is an interface between off-set notch 302 (at the end of the handle extension 301) and an off-set protrusion 171 of the drive shaft end cap 17, as depicted in FIG. 6. This engagement of the off-set protrusion 171 into the off-set notch 302 can only take place when the switch drive shaft 20 is in proper alignment with external handle assembly 3. As a result, with this design all elements associated with the external handle assembly 3, the switch drive shaft 20 and, in turn, the proper position of the network switch contact assembly 6 can be installed only in proper alignment.

The perpendicular handle extension 301 is able to pass easily through the gland O-ring assembly because a liquid-tight seal is formed between the gland O-ring assembly 5 and the gland body 16. This is preferably accomplished through the use of a triple O-ring sealing system, designed for redundancy. The O-rings are made of Viton®, designed for use at a temperature range between −25° C. minimum and 204° maximum. With this design, after initial installation, there is no need for any adjustment to this particular sealing system.

Figure 5:
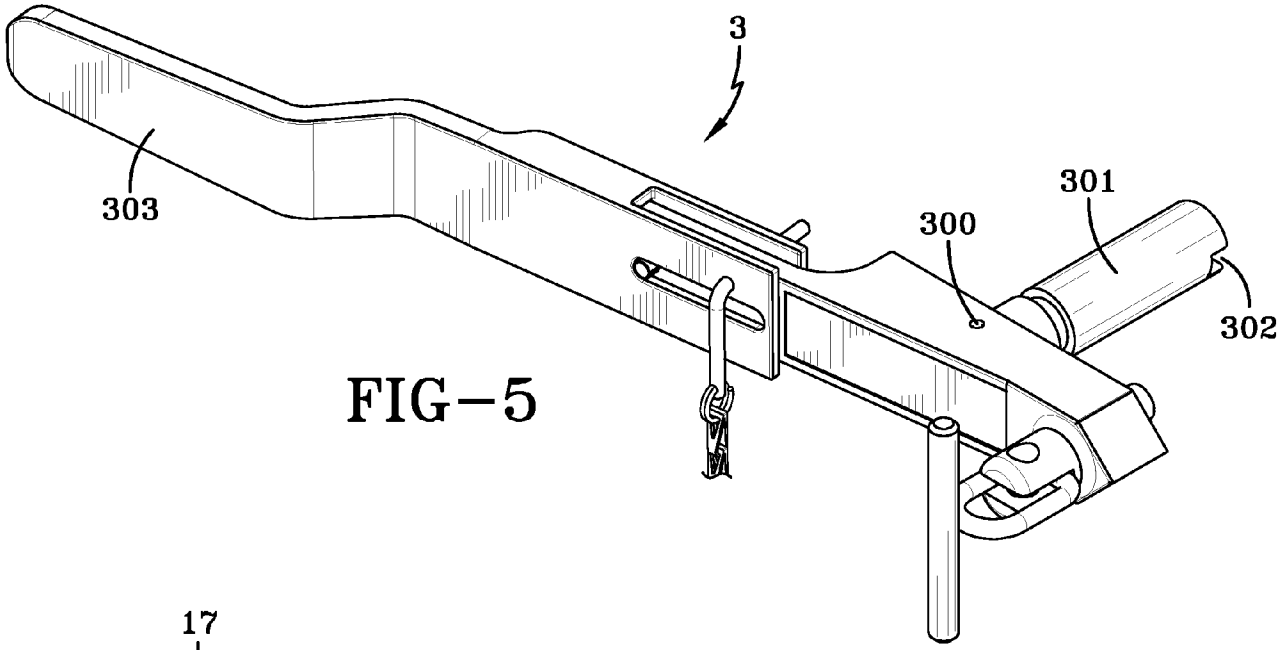
FIG. 5 is a perspective view of the external handle, including a portion of the handle assembly that would extend through a gland assembly and into the liquid containment tank.
Figure 6:
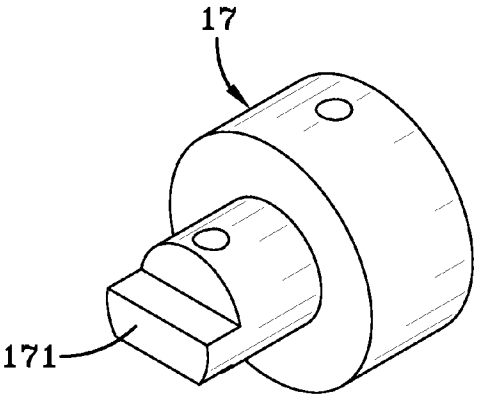
FIG. 6 is a detailed view of the end of the switch drive shaft configured to interface with the external handle within the liquid-tight tank.

Further describing the handle assembly, FIG. 5 depicts the location of safety shear pin 300. This pin is best located at an intersection where force on collapsible/folding handle extension 303 is transferred to rotational force (i.e., torque) on perpendicular handle extension 301 to rotate the switch drive shaft 20. The purpose of safety shear pin 300 is to fail when torque is destructively overpowering, thereby disconnecting collapsible handle extension 303 from the perpendicular drive shaft 301 of the handle assembly 3. More specifically, the safety shear pin 300 is designed to fail at when maximum allowable force exerted on external handle assembly 3 is exceeded (i.e., before such force reaches a level to be destructive to the switch gear or the safety devices by breaking the connection for rotation of switch drive shaft 20). It should be clear that the strength and size of safety shear pin 300 can be adjusted based upon the amount of torque which is necessary to operate the switch at extreme levels (such as breaking a welded contact) while still failing before truly destructive force can be applied to the overall switch gear assembly 100.

By way of example, in one embodiment, the safety shear pin 300 is preferably a $3/16^{th}$ inch diameter grooved pin. Upon failing, broke safety shear pin 300 can easily be replaced with a simple hammer and punch to drive the safety shear pin 300 out of the external handle assembly. Then, a new pin can be inserted. Thus, repair is vastly simplified and efficient.

Moreover, the advantage of the present arrangement depicted in FIG. 5 is that the safety shear pin 300 is in a very convenient location for replacement. In prior designs, the weak link was contained within the liquid containment tank 60. This required substantial maintenance time and effort when destructive force was applied to the switch (often the entire switch had to be replaced).

Further describing the external handle assembly 3 in FIG. 5, it includes the collapsible handle extension 303 identified supra. This can be collapsed or shortened in order to save space within the confined work space or vault in which the liquid containment tank 60 is contained. The collapsible handle extension 303 of external handle assembly 3 provides the additional leverage to properly operate switch gear assembly 100 without providing any need to use a much longer external lever to operate the switch gear assembly 100. Using a pipe or some other overly long extension is a practice that very often occurs when operators believe that they do not have sufficient leverage with the otherwise provided external handle.

Figure 7A:
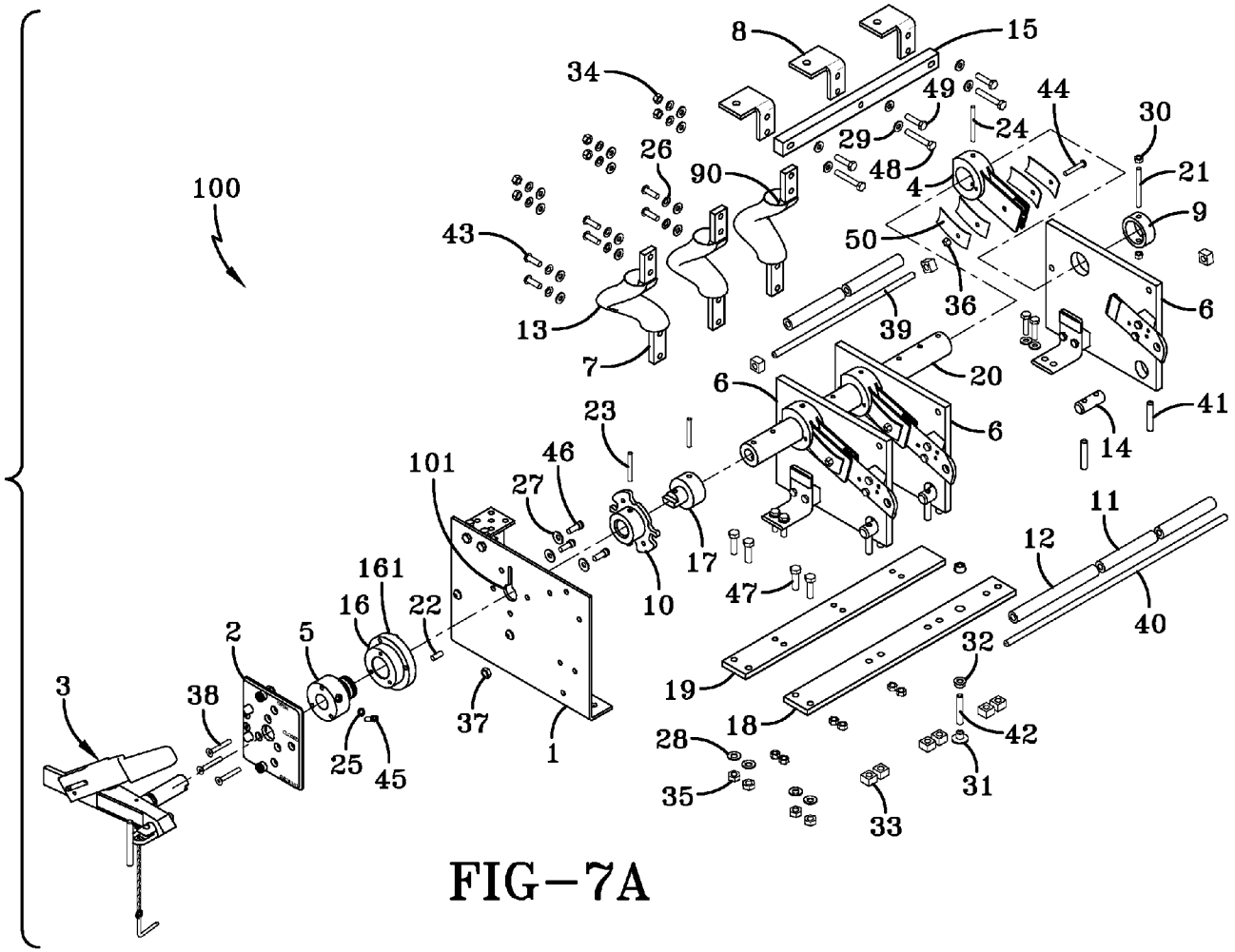
FIG. 7A is an exploded view of parts that can be used to assemble one embodiment of the switch modified in accordance with the safety system of the present invention.

With reference to FIG. 7A, which depicts an exploded view of one embodiment of the inventive switch gear assembly 100 described supra, while specific methods of connecting certain parts together are depicted or implied by this drawing, the present invention is not limited thereto. Rather, other means and combinations of achieving the same functionality can be used. Likewise, the parts list of FIG. 7B merely depicts certain parts that can be used in connecting the various parts together. For example, while two grounded mounting rails, 18, 19 are depicted in FIG. 7A, a different structure can be used to provide the same support and function.

It should be understood that the safety system integrated into a liquid-insulated high voltage network grounding switch can be implemented in a variety of different manners. For example, in many instances, the roll pins 22, 23 depicted in FIG. 7A can be replaced by set screws or other connectors. Likewise, drive shaft end cap 17 can be originally formed as part of the switch drive shaft 20. To be clear, therefore, the present invention encompasses all variations, permutations, modifications, derivations, and embodiments that would occur to one skilled in this art, once in possession of the teachings of this patent application. Accordingly, the invention should be construed as being limited only by the following claims.

We claim:

1. A high voltage network grounding switch safety system operationally mounted to a liquid-tight tank, wherein said network grounding switch includes a rotary multi-position, 3-phase arrangement comprising at least three switch input connecting points, at least three rotating paired blades affixed to a shaft, each paired blade interfacing with at least one switch output connection, the grounding switch safety system further including a ground bus, an exterior ground connector, at least three secondary switch blades, and incoming bushings with each bushing having internal and external electrical connection points, and further wherein said tank is configured with a mounting structure for securing at least a portion of said network grounding switch within said liquid containment tank, and wherein said switch safety system further comprises:

a) a liquid-tight gland for passage of the shaft to an external handle to control rotation of said shaft from outside said tank;

b) an offset interface between said external handle and said drive shaft of said network grounding switch for extension through said gland;

c) an exterior safety shear pin secured to said external handle and said shaft;

d) a ground path connecting a tank interior and said switch through an internal plate fixed in proximity to said liquid-tight gland; and e) a flexible connection between at least one of said switch input connecting points and at least one of said internal electrical connection points of said incoming bushings; and, f) wherein each of said secondary switch blades includes at least one contact pad.

2. The high voltage network grounding switch safety system of claim 1, wherein said liquid-tight gland comprises a gland body and a detachable O-ring assembly comprising resilient O-rings.

3. The high voltage network grounding switch safety system of claim 1, wherein said exterior safety shear pin comprises at least a $3/16^{th}$ inch diameter.

4. The high voltage network grounding switch safety system of claim 1, wherein said off-set interface between said external handle and said drive shaft comprises an extension perpendicular from said external handle.

5. The high voltage network grounding switch safety system of claim 2, wherein said gland body is welded to a sidewall of said liquid-tight tank.

6. The high voltage network grounding switch safety system of claim 5, wherein said body of said gland is bolted to said internal plate.

7. The high voltage network grounding switch safety system of claim 4, wherein said off-set interface between said external handle and said shaft of said network grounding switch further comprises an off-center notch and a corresponding off-center protrusion for alignment and mating engagement therebetween.

8. The high voltage network grounding switch safety system of claim 1, wherein said flexible connection comprises a braided metallic structure.

9. The high voltage network grounding switch safety system of claim 1, wherein each said secondary switch blade comprises at least two contact pads.

10. The high voltage network grounding switch safety system of claim 1, wherein each of said paired blades comprises an external leaf spring configured to exert pressure on one of said secondary switch blade aligned between and engaged by said respective paired blade.

11. The high voltage network grounding switch safety system of claim 1, further comprising a toggle switch delay system and a solenoid interlock arranged to hinder operation of said grounding switch under predetermined conditions.

12. The high voltage network grounding switch safety system of claim 1, wherein the mounting structure is positioned beneath said three rotating paired blades, and connected to said internal plate.

* * * * *